US007448489B2

(12) United States Patent
Reichenbach

(10) Patent No.: US 7,448,489 B2
(45) Date of Patent: Nov. 11, 2008

(54) APPARATUS FOR TRANSPORTING WORKPIECES IN PRESSES

(75) Inventor: Rainer Reichenbach, Schlier (DE)

(73) Assignee: Müller Weingarten AG, Weingarten (DE)

( * ) Notice: Subject to any disclaimer, the term of this patent is extended or adjusted under 35 U.S.C. 154(b) by 0 days.

(21) Appl. No.: 11/490,926

(22) Filed: Jul. 21, 2006

(65) Prior Publication Data

US 2006/0260381 A1 Nov. 23, 2006

Related U.S. Application Data

(63) Continuation of application No. PCT/EP2005/000800, filed on Jan. 27, 2005.

(30) Foreign Application Priority Data

Jan. 30, 2004 (DE) ..... 10 2004 005 046

(51) Int. Cl.
*B65G 25/02* (2006.01)
*B21J 11/00* (2006.01)

(52) U.S. Cl. ..... 198/621.1; 72/405.13

(58) Field of Classification Search ..... 198/621.1, 198/468.2; 414/749.6, 751.1; 72/405.01, 72/405.11, 405.13; 100/207, 215, 218; 29/563
See application file for complete search history.

(56) References Cited

U.S. PATENT DOCUMENTS

| | | | | |
|---|---|---|---|---|
| 4,823,587 A | | 4/1989 | Wolfgang et al. | |
| 4,887,446 A | | 12/1989 | Maher | |
| 5,003,808 A | * | 4/1991 | Maher | 72/405.13 |
| 5,423,202 A | | 6/1995 | Komatsu et al. | |
| 5,557,959 A | * | 9/1996 | Wallis et al. | 72/20.2 |
| 5,640,875 A | * | 6/1997 | Horde et al. | 72/405.13 |
| 5,771,561 A | * | 6/1998 | Hofele | 29/563 |
| 5,802,967 A | | 9/1998 | Thudium et al. | |
| 5,803,231 A | * | 9/1998 | Lauke | 198/621.1 |
| 6,176,365 B1 | * | 1/2001 | Klemm | 198/621.1 |
| 6,185,979 B1 | * | 2/2001 | Schollhammer | 72/405.16 |
| 6,234,302 B1 | * | 5/2001 | Greiner et al. | 198/621.1 |
| 7,128,195 B2 | * | 10/2006 | Childs | 198/339.1 |

FOREIGN PATENT DOCUMENTS

| | | |
|---|---|---|
| DE | 3 636 010 A1 | 4/1988 |
| DE | 3 636 011 A1 | 4/1988 |
| DE | 43 36 854 A1 | 5/1995 |
| DE | 195 28 002 A1 | 2/1997 |
| DE | 101 58 194 A1 | 6/2003 |
| EP | 0 728 543 A1 | 8/1996 |
| EP | 0 838 281 A1 | 4/1998 |
| EP | 0 842 719 A1 | 5/1998 |

* cited by examiner

*Primary Examiner*—Douglas A Hess
(74) *Attorney, Agent, or Firm*—Burr & Brown

(57) ABSTRACT

A transporting apparatus, in particular a 3-way transfer means, for transfer presses, in the case of which, for horizontal movement, linear drives are attached and actuated such that, along with a compact construction, the linear drives allow the gripper rails to be changed straightforwardly during tool-changing operations.

8 Claims, 5 Drawing Sheets

APPARATUS FOR TRANSPORTING WORKPIECES IN PRESSES

CROSS REFERENCE TO RELATED APPLICATIONS

This application is a continuation of International Application No. PCT/EP2005/000800, having an international filing date of Jan. 27, 2005, which designated the United States, and claims the benefit of German Application No. 10 2004 005 046.5, filed Jan. 30, 2004, the entireties of which are incorporated herein by reference.

FIELD OF THE INVENTION

The invention relates to an apparatus for transporting workpieces through processing stations of a press, in particular a transfer press or the like.

BACKGROUND OF THE INVENTION

If the production of a workpiece necessitates a number of processing sequences, such as cutting and forming, then, for cost-effective production, the necessary individual operations are carried out in a so-called transfer press. The number of tools then corresponds to the number of operating stages which are necessary for producing the workpieces.

The presses contain transporting apparatuses, which transport the workpieces from one work station to the next. The transporting apparatus may be configured as a 2-way transfer means or 3-way transfer means, the movement axes of the transporting means thereby being defined. A 2-way transfer means is provided with supporting rails, which run through the press on both sides. Crossmembers equipped with suction devices or the like are fastened on the supporting-rails for workpiece-transporting purposes The crossmembers execute simultaneous horizontal and vertical movements.

In the case of a 3-way transfer means, the supporting rails are designed as so-called gripper rails, which, in addition to horizontal and vertical movements, also execute a transverse movement and grip the workpiece by means of gripper elements in order to transport the workpiece from one processing stage to the next. The 3-way or gripper-type transfer means is preferably used in practice for transporting flexurally rigid sheet-metal parts which can be gripped from the outside.

Driving action along the 3 axes can take place directly, via cam plates and levers, by means of the press drive, or each movement axis is provided with a dedicated drive. A 3-way transfer means with dedicated drives in each case is disclosed in U.S. Pat. No. 4,887,446. The vertical movement and the closing movement, in the direction transverse to that in which workpieces run through the press, take place by means of electric motors or hydraulic cylinders. An electric linear drive is proposed for executing the horizontal movement of the supporting rails.

No further details are given in U.S. '446 regarding the linear drive and, in particular, there are no further details regarding the lengths of the primary and secondary parts. Similarly, U.S. '446 does not disclose that a gripper-rail change is necessary for retooling purposes.

An arrangement for coupling and uncoupling gripper-rail parts is described in detail in DE 36 36 010. An arrangement based on the principle of a swivel-type tensioning clamp is proposed as the connecting element or gripper-rail lock. In addition to the necessary complex configuration, the task of achieving a clearance between the gripper-rail parts, for the changeover operation, requires considerable outlay.

Instead of the horizontal movement of the supporting rails, this movement can also be produced by virtue of transporting carriages on the supporting rails.

SUMMARY OF THE INVENTION

An object of the invention is to design, for a press and in particular for a transfer press with 2-way or 3-way transfer means, a linear drive for the horizontal movement such that the linear drive is of cost-effective design and, even while meeting stringent power-related requirements, provides for a compact construction. In addition, during tool-changing operations, the linear drive is intended to allow the gripper rails to be exchanged in a straightforward manner.

The present invention is based on the idea of providing two linear drives per supporting rail to effectuate the horizontal movement. These linear drives are arranged such that the supporting rail can be changed in a straightforward manner. For this purpose, the linear motors are located essentially at the outer ends of the supporting rail. These outer ends are separate from the supporting rail, which is to be exchanged and are connected to the supporting-rail in a releasable manner via supporting-rail locks. The supporting-rail locks are likewise located in separate endpieces, and only a clamping head engages in the supporting rail, which is to be exchanged. For the changeover operation, the connection is released and, by means of the linear motors, the endpieces are moved horizontally apart from one another by a defined distance, this resulting in a straightforward tool-changing operation. This movement sequence advantageously allows the supporting-rail lock to be designed in a very straightforward form. In the case of a 3-way transfer means, the supporting rail is designed as a gripper rail.

For the actual retooling operation, the press bed is designed as a sliding table, on which the tool is located. It is also the case that all of the component-dependent accessories, which are necessary for workpiece-transporting purposes, are likewise set down on the sliding table and moved out of the press.

A new tool is clamped in place, and the component-dependent accessories are arranged on a sliding table located outside the press. Following a changeover of the sliding tables, the press is converted, in a fully automatic manner, to the new production. The supporting-rail parts, which have been exchanged, are also clamped in position by the supporting-rail locks. For this purpose, the linear drives move the supporting-rail endpieces, with the supporting-rail locks located therein, in the direction of the supporting rail to the extent where the clamping heads can engage in the mount provided in the supporting rail. The supporting-rail locks clamp the supporting rail and the endpieces together, and the supporting rail is also thereby fixed to the linear drive.

The use of linear drives advantageously fulfills the object of the invention. Relatively recent developments make available highly dynamic drives with quick displacement sequences. Since these drives operate without any wear, a constant high level of positioning accuracy is ensured throughout the service life of the drive.

A compact and low-cost configuration is achieved on account of (i) the high power density of the linear drives (ii) the fact that there are two drives per supporting rail, and (iii) the drives are integrated directly at the supporting-rail ends.

A further advantage of using two drives is that the operational reliability increases since, in the event of one drive failing, the second drive moves the supporting rail and, in particular, the grippers mounted to the gripper rail, out of the collision zone.

The invention is used particularly advantageously in the case of a 3-way transfer means. Further advantages and details of the invention can be gathered from the description and from the figures showing an exemplary embodiment.

DETAILED DESCRIPTION OF THE INVENTION

Figure 1:
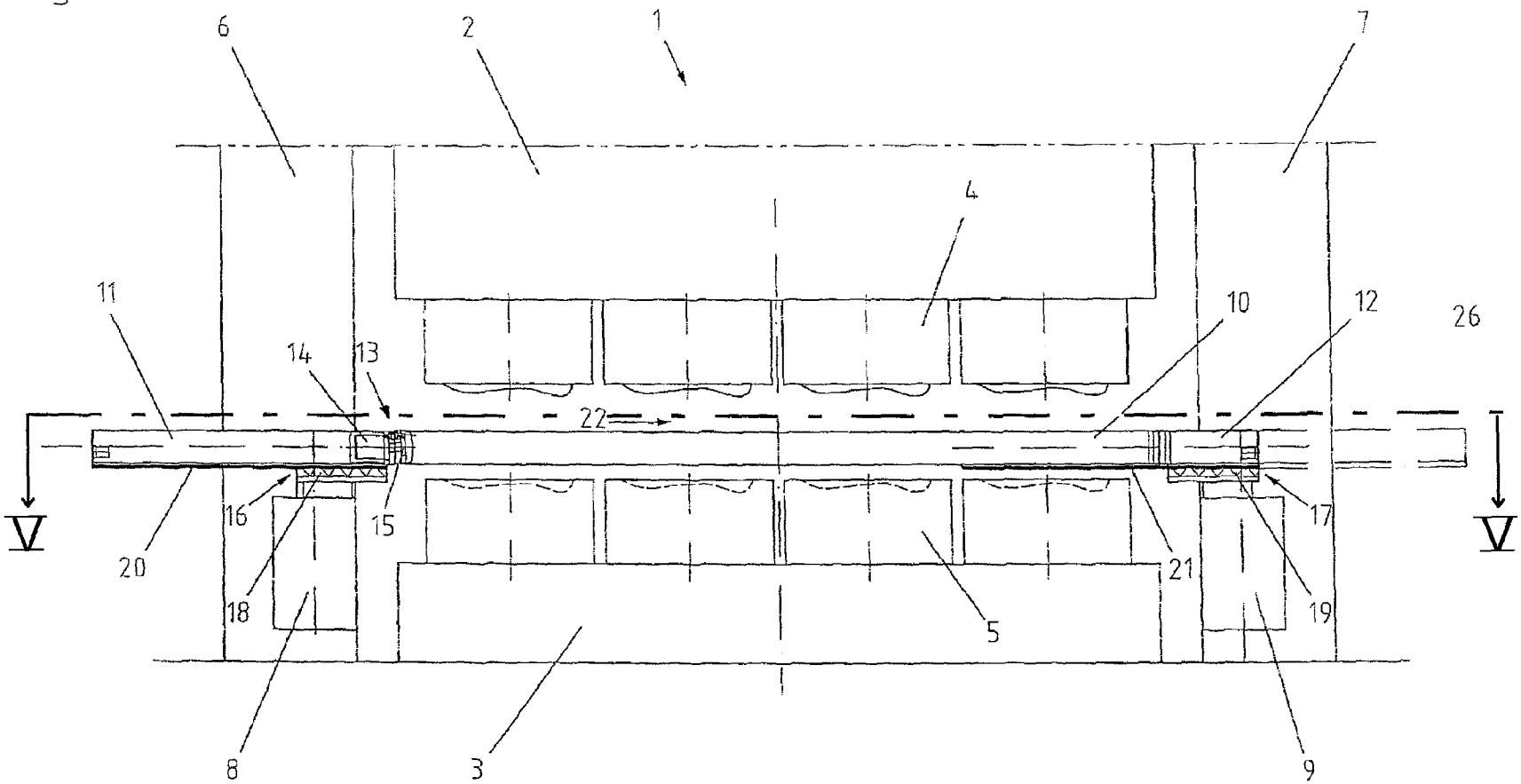
FIG. 1 shows a view of part of a transfer press with a supporting rail, which is designed as a gripper rail, clamped in place.

The following embodiment of the present invention describes a 3-way transfer means with gripper-rail drive. FIG. 1 illustrates a transfer press 1, the ram 2 and sliding table 3, on which the upper tools 4 and lower tools 5 are fastened. The so-called closing boxes 8, 9 are arranged in the region of the uprights 6, 7. These closing boxes 8, 9 are provided with drive means which execute a vertical and a closing displacement of the gripper rail 10. Such closing boxes 8, 9 are known and are described in detail, for example, in the applicant's patent, DE 43 36 854 A1, the entirety of which is incorporated herein by reference. The gripper rail 10 also has the gripper-rail endpieces 11, 12. Gripper-rail locks 13 connect the gripper rail 10 to the endpieces 11, 12. The gripper-rail locks 13 are configured as swivel-type tensioning clamps or rotary tensioning clamps. The gripper-rail locks 13 and the basic bodies 14 are integrated with the clamping drive, directly in the hollow profile 25 (FIG. 3) of the gripper-rail endpieces 11, 12, while the clamping heads 15 engage, and provide for clamping action, in the corresponding mounts of the gripper rail 10.

The linear drives 16, 17 each comprise a primary part 18, 19 and a secondary part 20, 21. The primary part 18, 19 is arranged on the closing boxes 8, 9. The secondary part 20 is connected to the gripper-rail endpiece 11, while the secondary part 21 is divided, and is fastened on both the gripper rail and the gripper-rail endpiece 12. In the case of the 3-way transfer means, the linear drives 16, 17 produce the horizontal movement along the longitudinal axis 26 of the gripper-rail 10 such that the workpieces are moved in the transporting direction 22 and the return displacement counter to the transporting direction 22.

It is easy to recognize the short and compact construction of the drives as a result of the secondary part 21 being in divided form, in accordance with the present invention.

Figure 2:
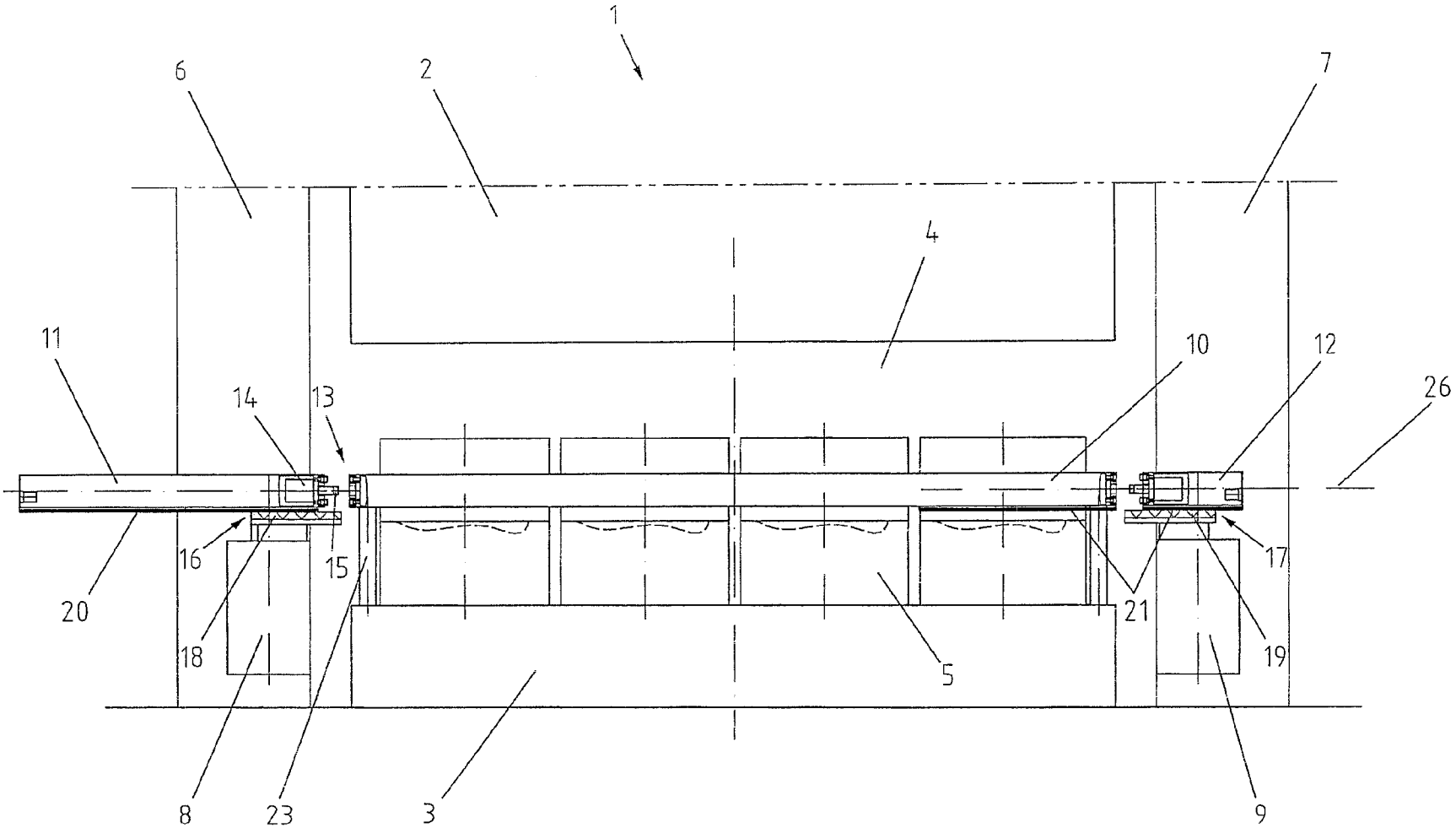
FIG. 2 shows the view in FIG. 1, but with the gripper rail released.

FIG. 2 shows a tool-changing situation. The gripper-rail locks 13 are open and, by virtue of the linear drives 16, 17, the gripper-rail endpieces 11, 12 have been moved horizontally apart from one another, in opposite directions The horizontal movement produces a clearance in relation to the gripper rail 10 uncoupling the gripper-rail 10 from the gripper-rail end pieces 11, 12. The uncoupled gripper rail 10 is set down, and retained, on mounts 23 located on the sliding table 3.

Dividing up the secondary part 21 into a part, which is fastened on the gripper rail 10, and a part, which is located on the gripper-rail endpiece 12, provides for an extremely short construction and a short horizontal displacement path. This makes it possible to provide for the clearance, which is necessary for gripper-rail-changing purposes.

Figure 3:
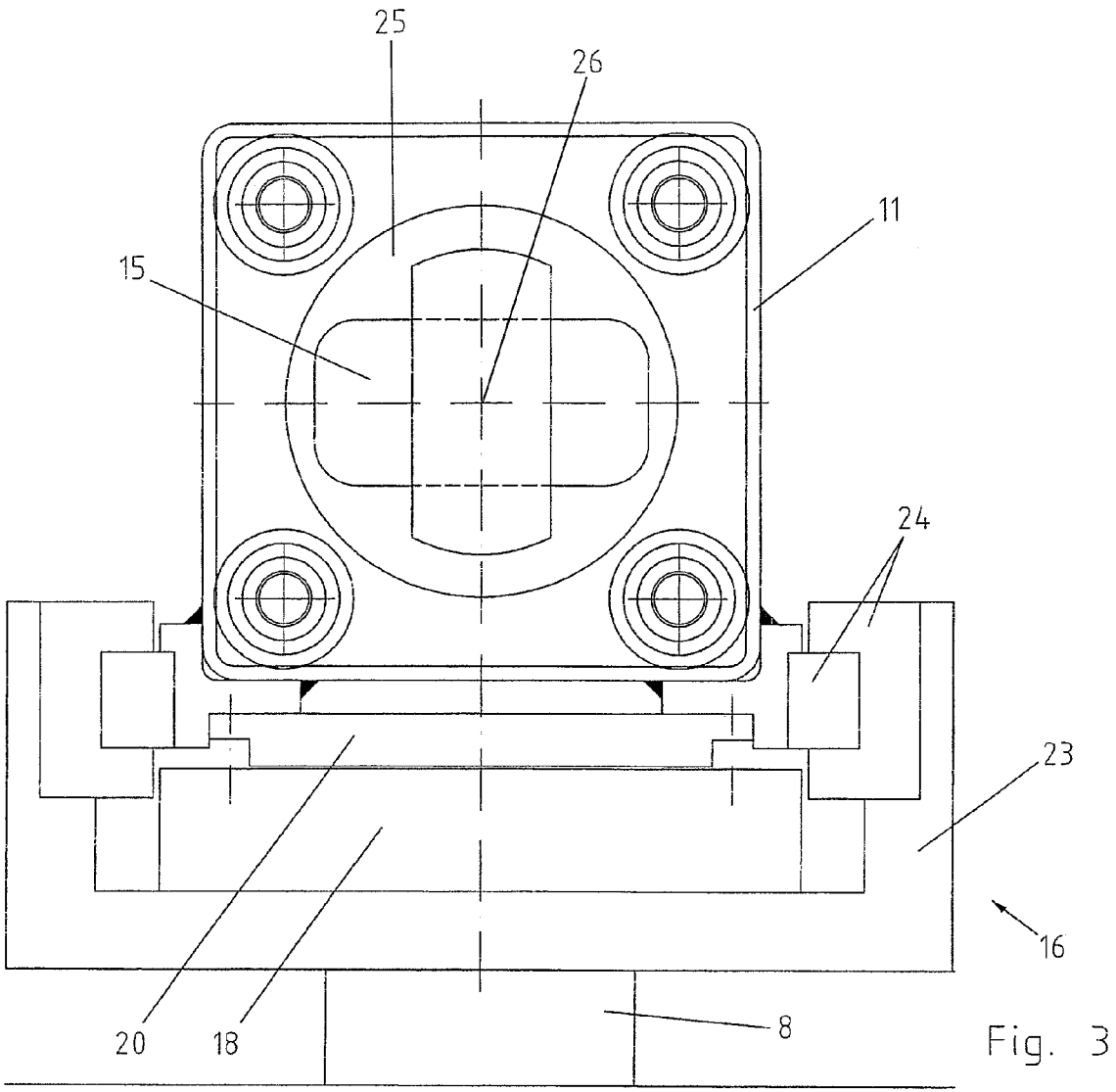
FIG. 3 shows a detail of the gripper rail.
Figure 4:
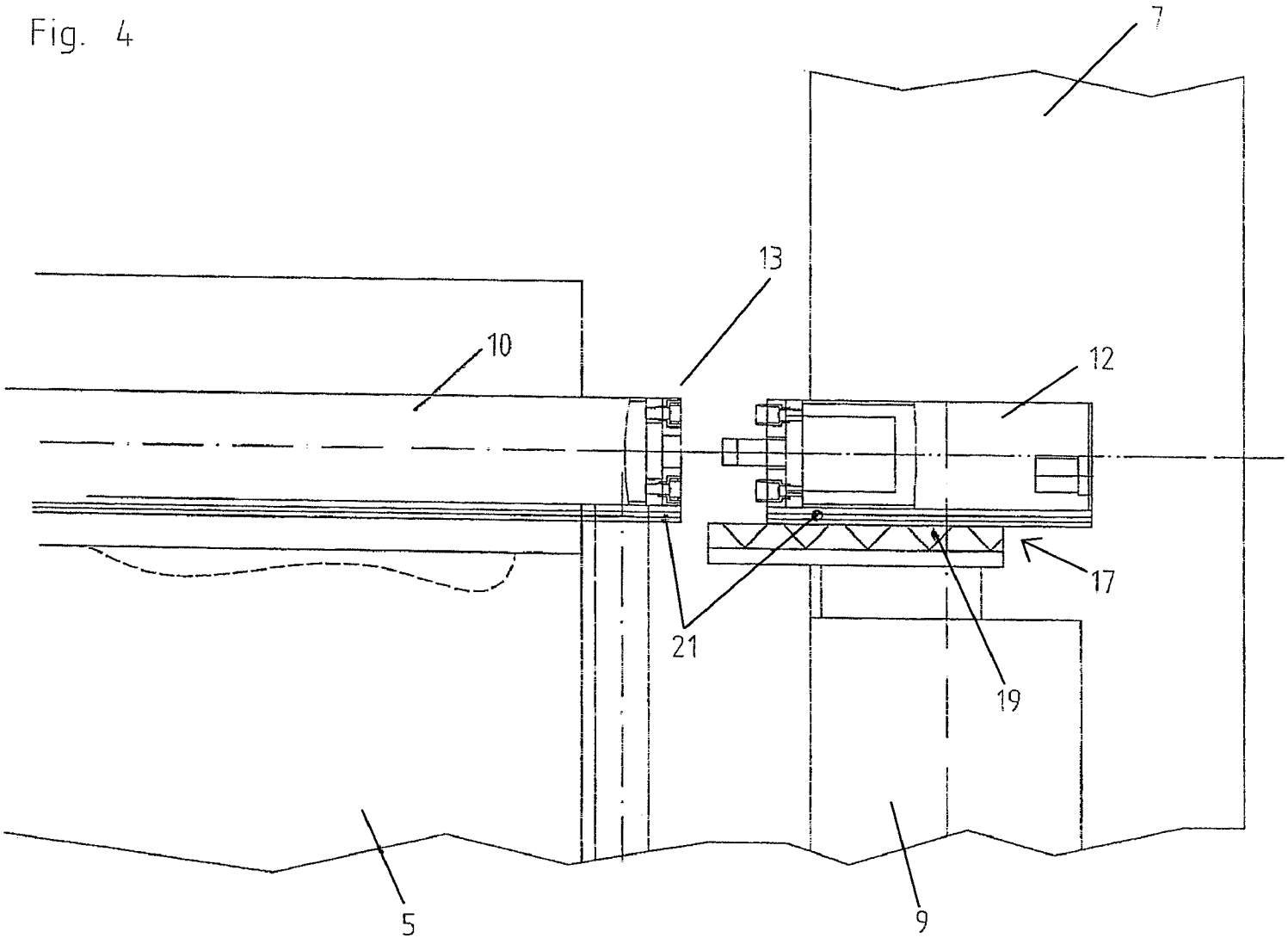
FIG. 4 shows an enlarged view of the right side of the released gripper rail as shown in FIG. 2.
Figure 5:
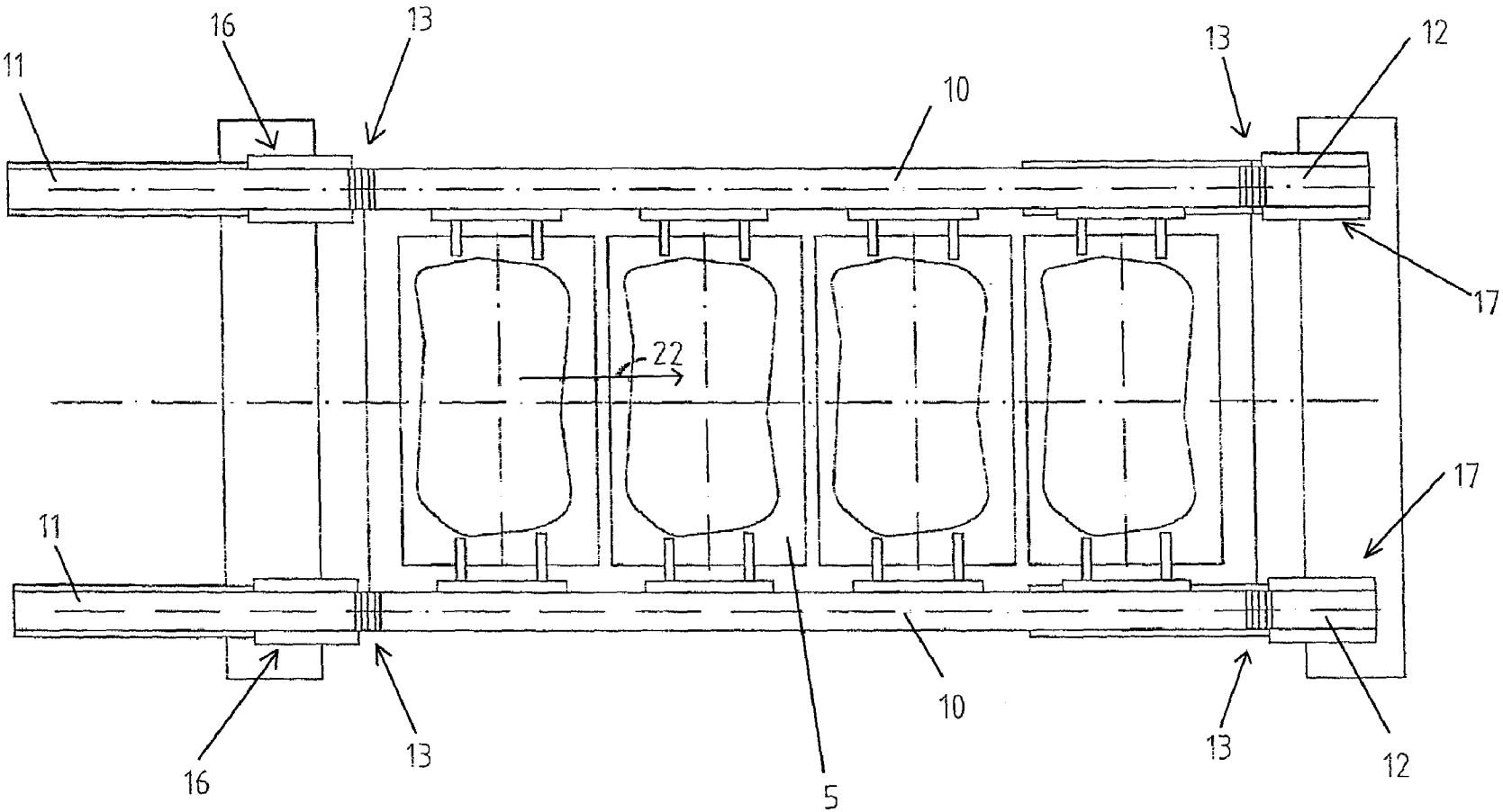
FIG. 5 shows a plan view of the transfer press and gripper rail of FIG. 1 as seen from the section line V-V.

FIG. 3 shows a detail of the invention. The sectional illustration, in the region where the gripper rail is divided, shows the arrangement of the linear drive 16. The primary part 18 is connected to a mount 23 of the closing box 8. The secondary part 20 is fastened on the gripper-rail endpiece 11. The clamping head 15 of the gripper-rail lock is located in a pivoted-in clamping position.

The gripper-rail endpiece 11 is guided and retained in the mount 23 by the linear guides 24.

The invention is not restricted to the exemplary embodiment illustrated and described. It also covers all specialized developments within the context of the idea according to the invention.

It is thus also possible to use just one linear drive in order to change the gripper rail. The following schematic sequence is then necessary:

- opening the gripper-rail lock, which is located on the side opposite to the active linear drive;
- displacing the gripper rail into the changeover position;
- opening the gripper-rail lock on the linear-drive side; and
- displacing the endpiece, by way of the linear drive, by the distance which is necessary for changing the gripper rail.

Of course, the apparatus according to the invention of the exemplary embodiment can also be transferred, in principle, to a 2-way transfer means with suction-bar workpiece transportation.

LIST OF DESIGNATIONS

1 Transfer press
2 Ram
3 Sliding table
4 Upper tool
5 Lower tool
6 Upright
7 Upright
8 Closing box
9 Closing box
10 Gripper rail
11 Gripper-rail endpiece
12 Gripper-rail endpiece
13 Gripper-rail lock
14 Basic body
15 Clamping head
16 Linear drive
17 Linear drive
18 Primary part
19 Primary part
20 Secondary part
21 Secondary part
22 Transporting direction
23 Mount
24 Linear guide
25 Hollow profile
26 Longitudinal axis

The invention claimed is:

1. An apparatus for transporting workpieces through processing stages of a transfer press, said apparatus comprising:

two supporting rails arranged parallel to one another, each having a longitudinal axis and opposing outer ends located along the longitudinal axis, the supporting rails facilitating the execution of, for workpiece-transporting purposes, a horizontal movement along the longitudinal axis in and counter to the workpiece-transporting direction;

at least one linear drive provided for each supporting-rail, each linear drive being located at one of the outer ends of each respective supporting-rail and each linear drive having a secondary part that is connected to at least one of two supporting-rail endpieces that engage the outer ends of each supporting-rail, the secondary part being divided into one part that is arranged on the supporting-rail endpiece and another part that is arranged on the supporting-rail, such that these parts form a unit when a supporting-rail lock is clamped in position, the two supporting-rail end pieces of each respective supporting-rail being movable apart from one another by a defined clearance to allow the supporting-rails to be changed during tool-changing operations; and supporting-rail locks provided to connect each supporting-rail and respective supporting-rail end pieces.

2. The transporting apparatus as claimed in claim 1, wherein the supporting rail is connected to the supporting-rail endpieces by the supporting-rail locks.

3. The transporting apparatus as claimed in claim 2, wherein the supporting-rail endpieces can be displaced independently of one another, and in opposite directions, when the supporting locks are open.

4. The transporting apparatus as claimed in claim 2, wherein both supporting-rail locks and at least one of the linear drives are used in order to create the clearances for changing the supporting rails.

5. The transporting apparatus as claimed in claim 1, wherein the linear drives can be displaced independently of one another.

6. The transporting apparatus as claimed in claim 1, wherein basic bodies of the supporting-rail locks are integrated in a hollow profile of the supporting-rail endpieces.

7. The transporting apparatus as claimed in claim 1, wherein the linear drives are only partially arranged on the supporting-rail endpieces.

8. The transporting apparatus as claimed in claim 1, wherein the supporting-rail locks are rotary tensioning clamps.

* * * * *